US006655178B1

(12) United States Patent
Lingbeck

(10) Patent No.: US 6,655,178 B1
(45) Date of Patent: Dec. 2, 2003

(54) DOOR LOCK AND LATCH ASSEMBLY

(76) Inventor: David A. Lingbeck, 12675 Germane Ave., #1, Apple Valley, MN (US) 55124

( * ) Notice: Subject to any disclaimer, the term of this patent is extended or adjusted under 35 U.S.C. 154(b) by 0 days.

(21) Appl. No.: 10/139,870

(22) Filed: May 8, 2002

(51) Int. Cl.[7] ..... E05B 63/14; E05B 65/06

(52) U.S. Cl. ..... 70/114; 70/116; 70/134; 292/DIG. 41

(58) Field of Search ..... 70/114, 116, 107, 70/134; 292/336.3, 4, 5, 8, 346, DIG. 2, DIG. 41

(56) References Cited

U.S. PATENT DOCUMENTS 514,511 A * 2/1894 Sorensen ..... 292/8
1,966,171 A * 7/1934 Holtzman ..... 70/114
2,557,670 A * 6/1951 Luft ..... 70/72
4,237,710 A * 12/1980 Cardozo ..... 70/108
4,239,268 A * 12/1980 Rider ..... 292/5
4,656,849 A * 4/1987 Rotondi et al. ..... 70/134
5,695,227 A * 12/1997 Smallegan et al. ..... 292/336.3

* cited by examiner

*Primary Examiner*—Anthony Knight
*Assistant Examiner*—Michael J. Kyle

(57) ABSTRACT

A door lock and latch assembly for securely locking a door to prevent a person from using a tool to spread the door away from the door frame. The door lock and latch assembly includes a lock and latch support assembly being adapted to mount to a door and including a rotatable shaft; and also includes a deadbolt lock assembly being mounted to the rotatable shaft and being adapted to be disposed in the door; and further includes a latch assembly including a lever being mounted to the rotatable shaft and also including a catch being adapted to mount to a structure adjacent to the door.

9 Claims, 3 Drawing Sheets

DOOR LOCK AND LATCH ASSEMBLY

BACKGROUND OF THE INVENTION

1. Field of the Invention

The present invention relates to combination door locks and latches and more particularly pertains to a new door lock and latch assembly for securely locking a door to prevent a person from using a tool to spread the door away from the door frame.

2. Description of the Prior Art

The use of combination door locks and latches is known in the prior art. More specifically, combination door locks and latches heretofore devised and utilized are known to consist basically of familiar, expected and obvious structural configurations, notwithstanding the myriad of designs encompassed by the crowded prior art which have been developed for the fulfillment of countless objectives and requirements.

The prior art includes inventions having deadbolt locks being mounted to doors and other inventions having latches for fences as such. While these devices fulfill their respective, particular objectives and requirements, the aforementioned prior art do not disclose a new door lock and latch assembly.

SUMMARY OF THE INVENTION

The general purpose of the present invention, which will be described subsequently in greater detail, is to provide a new door lock and latch assembly which has many of the advantages of the combination door locks and latches mentioned heretofore and many novel features that result in a new door lock and latch assembly which is not anticipated, rendered obvious, suggested, or even implied by any of the prior art combination door locks and latches, either alone or in any combination thereof. The present invention includes a lock and latch support assembly being adapted to mount to a door and including a rotatable shaft; and also includes a deadbolt lock assembly being mounted to the rotatable shaft and being adapted to be disposed in the door; and further includes a latch assembly including a lever being mounted to the rotatable shaft and also including a catch being adapted to mount to a structure adjacent to the door. None of the prior art describes inventions having a combination latch assembly and deadbolt lock assembly to prevent unauthorized entry in building structures even with the deadbolt lock assembly being engaged.

There has thus been outlined, rather broadly, the more important features of the door lock and latch assembly in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new door lock and latch assembly which has many of the advantages of the combination door locks and latches mentioned heretofore and many novel features that result in a new door lock and latch assembly which is not anticipated, rendered obvious, suggested, or even implied by any of the prior art combination door locks and latches, either alone or in any combination thereof.

Still another object of the present invention is to provide a new door lock and latch assembly for securely locking a door to prevent a person from using a tool to spread the door away from the door frame.

Still yet another object of the present invention is to provide a new door lock and latch assembly that fully protects one's property by preventing the intruder from using a crowbar to spread the door away from the door frame thus removing the deadbolt from the door frame.

Even still another object of the present invention is to provide a new door lock and latch assembly that is easy and convenient to use and can be implemented without having to do anything additional for locking and latching one's door.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
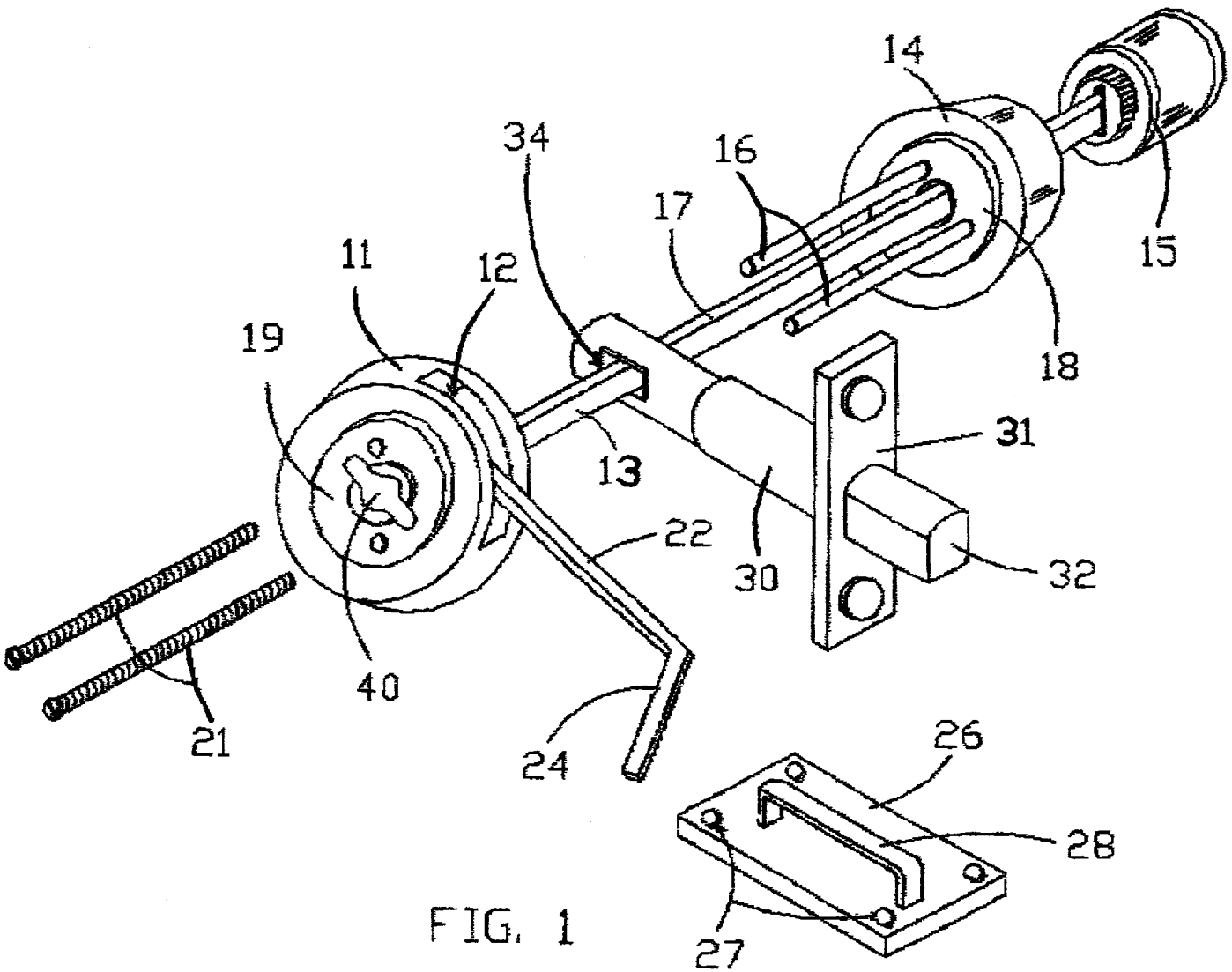
FIG. 1 is a perspective view of a new door lock and latch assembly according to the present invention.
Figure 2:
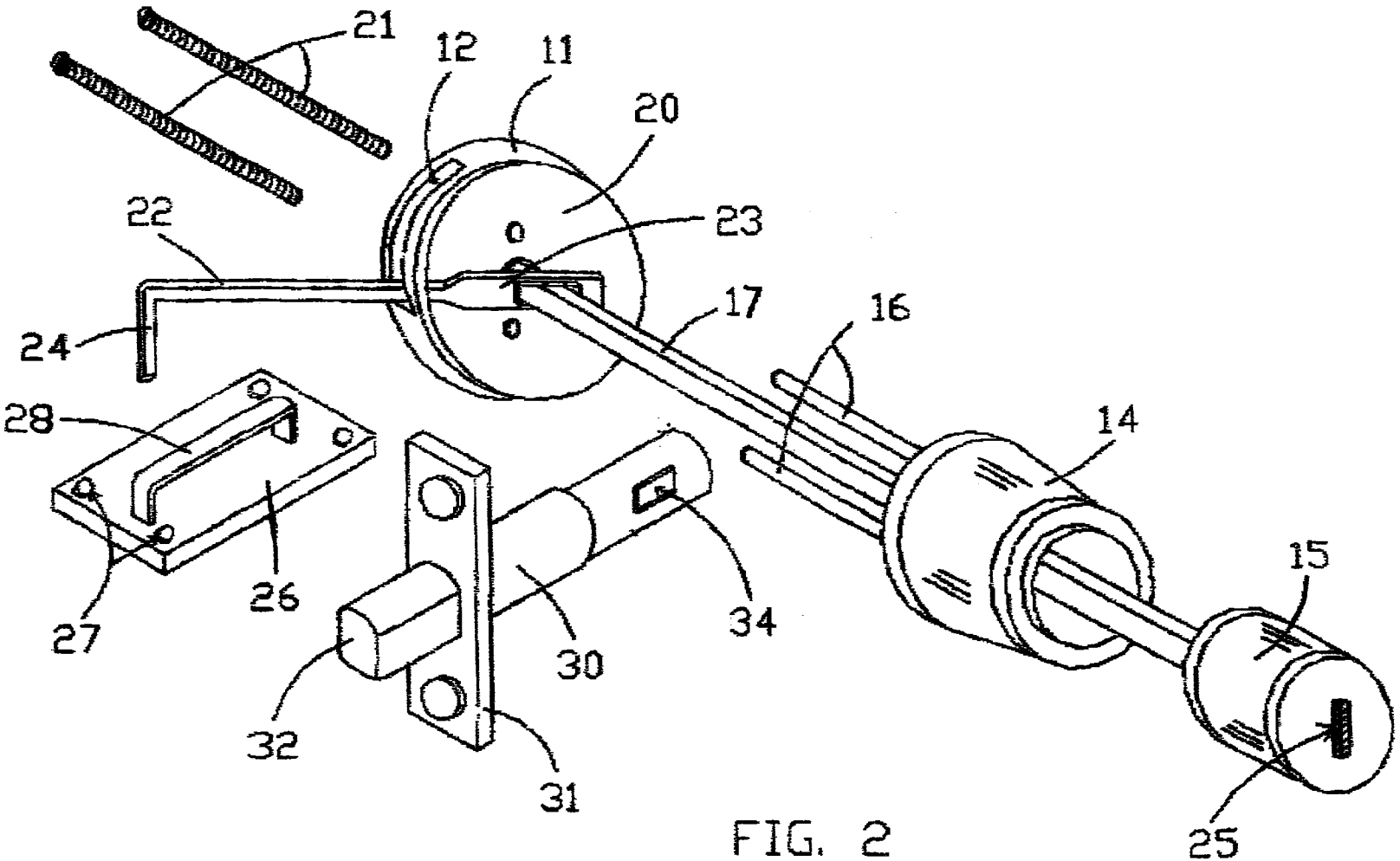
FIG. 2 is an exploded perspective view of the present invention.
Figures 3, 4:
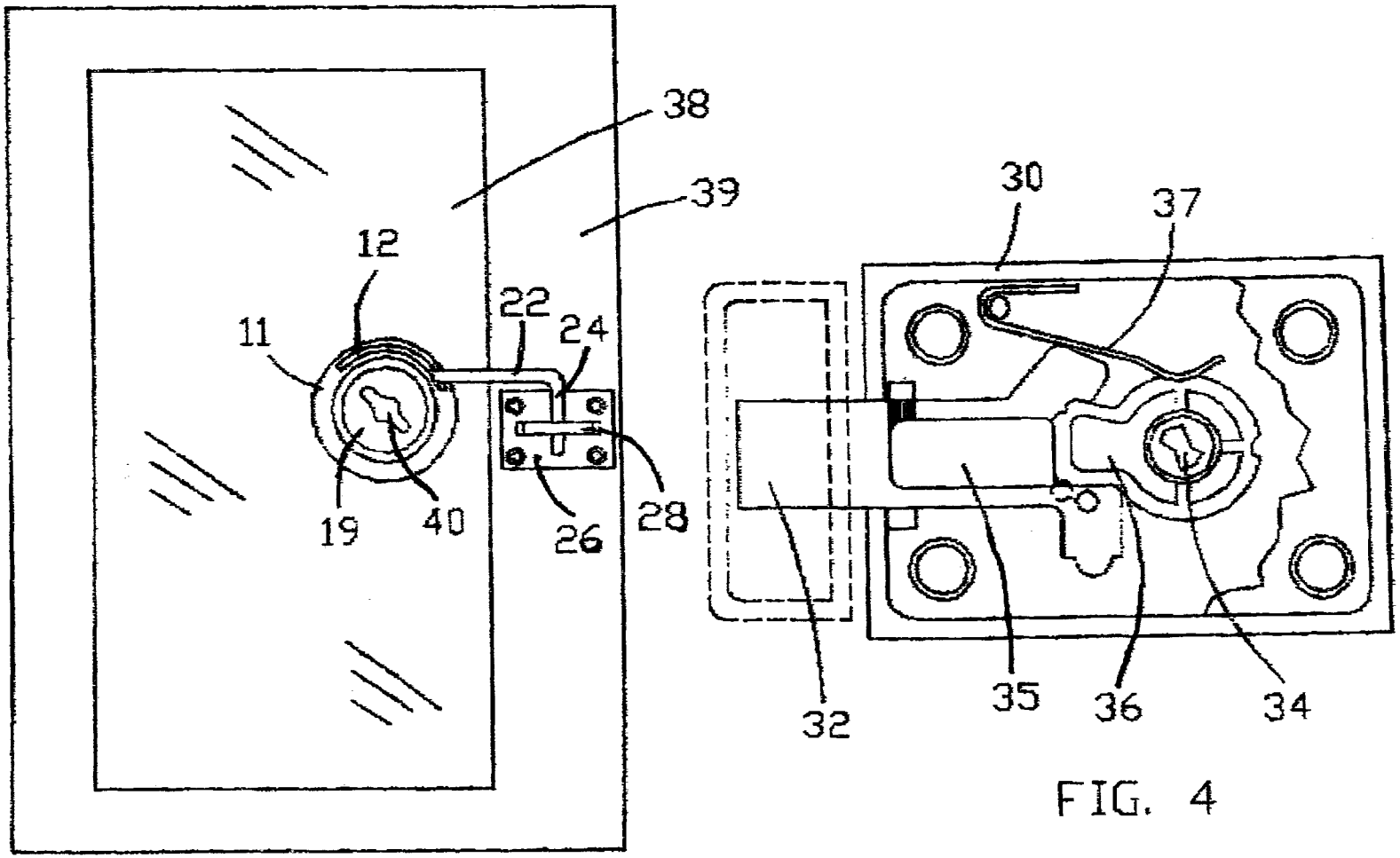
FIG. 3 is a front elevational view of the present invention shown in use.
FIG. 4 is a cross-sectional view of the deadbolt lock mechanism of the present invention.

With reference now to the drawings, and in particular to FIGS. 1 through 4 thereof, a new door lock and latch assembly embodying the principles and concepts of the present invention and generally designated by the reference numeral 10 will be described.

As best illustrated in FIGS. 1 through 4, the door lock and latch assembly 10 generally comprises a lock and latch support assembly being adapted to mount to a door 38 and including a rotatable shaft 13 having multiple sides 17. The lock and latch support assembly includes a cover member 11 being adapted to mount to the door 38 and having a rim portion and also having a circumferential-extending slot 12 being disposed through a portion of the rim portion. The lock and latch support assembly also includes a housing/cover member 14 being adapted to mount to the door 38 and being fastened to the cover member 11 with fastening members 21, and further includes elongate tubular support members 16 being conventionally attached to the housing/cover member 14 and receiving the fastening members 21 for securely mounting the cover member 11 and the housing/cover member 14 to opposite sides of the door 38. The lock and latch support assembly further includes a key mechanism 15 being conventionally supported by the housing/cover member 14 and having a tumbler housing with a key slot 25 being disposed therein and also with a shaft-receiving slot being disposed therein. The lock and latch support assembly also includes a lock knob 40 being rotatably and conventionally mounted to a front side 19 of the cover member 11 for rotating the rotatable shaft 13.

A conventional deadbolt lock assembly is conventionally mounted to the rotatable shaft 13 and is adapted to be disposed in the door 38. The deadbolt lock assembly includes a support plate 31 being adapted to be fastened to the door 38, and also includes a lock housing 30 being conventionally supported by the support plate 31, and further includes a deadbolt member 32 being movably disposed in and extended from the lock housing 30, and also includes a cam member 36 being rotatably and conventionally disposed in the lock housing 30 for moving the deadbolt member 32, and further includes a cam catch member 35 being conventionally disposed in the lock housing 30, and also includes a spring 37 for biasedly engaging the cam catch member 35 to engage the cam member 36 with the cam member 36 having a hole 34 being disposed therethrough with the hole 34 receiving the rotatable shaft 13 therethrough.

A latch assembly includes a lever 22 being conventionally mounted to the rotatable shaft 13 and also includes a catch 26 being adapted to fastenably mount to a structure 39 adjacent to the door. The lever 22 has an elongate main portion 23 having an end which is securely and conventionally attached to and about the rotatable shaft 13, and also has an end portion 24 which is angled relative to the elongate main portion 23. The lever 22 is movably extended through the circumferential-extending slot 12 and has a hole through which the rotatable shaft is extended 13. The catch 26 includes a loop support having holes 27 therethrough and being adapted to securely fasten to the structure 39 such as a door frame, and also includes a loop member 28 having ends being securely and conventionally attached to the loop support and having a main portion being spaced from the loop support with the end portion 24 of the lever 22 being removably received between the loop member 28 and the loop support to prevent spreading of the door 38 away from the door frame 39 so that the door 38 cannot be opened even with the deadbolt member 32 being extended into the door frame 39.

In use, the user locks and latches the door 38 by either turning the lock knob 40 or inserting a key into the key-receiving slot 25 of the key mechanism 15 and turning the rotatable shaft 13 which turns both the cam member 36 and the lever 22 to engage the deadbolt member 32 into the door frame 39 and to insert the end portion 24 of the lever 22 in the loop member 28. To unlock and unlatch the door 38, the user simply turns either the key or the lock knob 40 in the reverse direction.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the door lock and latch assembly. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A door lock and latch assembly comprising:

a lock and latch support assembly being adapted to mount to a door and including a rotatable shaft;

a deadbolt lock assembly being mounted to said rotatable shaft and being adapted to be disposed in the door; and a latch assembly including a lever being mounted to said rotatable shaft and also including a catch being adapted to mount to a structure adjacent to the door.

2. A door lock and latch assembly as described in claim 1, wherein said lock and latch support assembly includes a cover member being adapted to mount to the door and having a rim portion and also having a circumferential-extending slot being disposed through a portion of said rim portion.

3. A door lock and latch assembly as described in claim 2, wherein said lock and latch support assembly also includes a housing member being adapted to mount to the door and being fastened to said cover member with fastening members.

4. A door lock and latch assembly as described in claim 3, wherein said lock and latch support assembly further includes a key mechanism being supported by said housing member and having a tumbler housing having a key slot being disposed therein and also having a shaft-receiving slot also being disposed therein.

5. A door lock and latch assembly as described in claim 4, wherein said lock and latch support assembly also includes a lock knob being rotatably mounted to said cover member for rotating said rotatable shaft.

6. A door lock and latch assembly as described in claim 1, wherein said deadbolt lock assembly includes a support plate being adapted to be fastened to the door, and also includes a lock housing being supported by said support plate, and further includes a deadbolt member being movably disposed in and extended from said lock housing, and also includes a cam member being rotatably disposed in said lock housing for moving said deadbolt member, and further includes a cam catch member being disposed in said lock housing, and also includes a spring for biasedly engaging said cam catch member to said cam member, said cam member having a hole being disposed therethrough with said hole receiving said rotatable shaft therethrough.

7. A door lock and latch assembly as described in claim 2, wherein said lever has an elongate main portion having an end which is securely attached to said rotatable shaft, and also has an end portion which is angled relative to said elongate main portion.

8. A door lock and latch assembly as described in claim 7, wherein said lever is movably extended through said circumferential-extending slot and has a hole through which said rotatable shaft is extended.

9. A door lock and latch assembly as described in claim 7, wherein said catch includes a loop support being adapted to securely fasten to the structure such as a door frame, and also includes a loop member having ends being securely attached to said loop support and having a main portion being spaced from said loop support, said end portion of said lever being removably received between said loop member and said loop support to prevent spreading of the door away from the door frame so that the door can be opened even with said deadbolt being extended into the door frame.

* * * * *